US006352615B1

(12) United States Patent
Tavi et al.

(10) Patent No.: US 6,352,615 B1
(45) Date of Patent: Mar. 5, 2002

(54) METHOD AND EQUIPMENT IN A PAPER/BOARD MACHINE FOR REGULATION OF THE DIFFERENCE OF DRAW

(75) Inventors: Seppo Tavi; Harri Mustonen, both of Jyväskylä ; Antti Komulainen, Keuruu, all of (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/424,637

(22) PCT Filed: May 26, 1998

(86) PCT No.: PCT/FI98/00439

§ 371 Date: Feb. 22, 2000

§ 102(e) Date: Feb. 22, 2000

(87) PCT Pub. No.: WO98/54408

PCT Pub. Date: Dec. 3, 1998

(30) Foreign Application Priority Data

May 30, 1997 (FI) ..... 972303

(51) Int. Cl.[7] ..... D21F 11/00

(52) U.S. Cl. ..... 162/198; 162/263; 162/DIG. 10; 162/253; 162/254; 162/256; 162/262; 73/862.45; 73/37.7; 73/37.9; 73/159

(58) Field of Search ..... 162/198, DIG. 10, 162/DIG. 11, 253–4, 256, 262, 263, 266; 73/862.45, 37.7, 37.9, 159; 101/228, 484

(56) References Cited

U.S. PATENT DOCUMENTS

| | | | | |
|---|---|---|---|---|
| 4,919,049 | A | 4/1990 | Niedermaier et al. | 101/228 |
| 5,052,233 | A | 10/1991 | Rantala | 73/862.45 |
| 5,269,222 | A | 12/1993 | Johnson et al. | 101/228 |
| 5,674,551 | A | 10/1997 | Koskinen et al. | 427/8 |

FOREIGN PATENT DOCUMENTS

| | | | |
|---|---|---|---|
| FI | 80522 | 2/1990 | G01L/5/04 |
| FI | 94779 | 7/1994 | D21F/1/36 |

*Primary Examiner*—Stanley S. Silverman
*Assistant Examiner*—M. Halpern
(74) *Attorney, Agent, or Firm*—Steinberg & Raskin, P.C.

(57) ABSTRACT

The invention concerns an equipment in a paper/board machine for regulation of the difference of draw. In the solution in accordance with the invention, the difference of draw in the web is regulated on the basis of the measured tension of the web. Preferably, the regulation of the difference of draw takes place by regulating the drives at the inlet and/or outlet of a web run not supported by a wire.

7 Claims, 5 Drawing Sheets

METHOD AND EQUIPMENT IN A PAPER/BOARD MACHINE FOR REGULATION OF THE DIFFERENCE OF DRAW

FIELD OF THE INVENTION

The invention concerns a method and an equipment in a paper/board machine for regulation of the difference of draw.

BACKGROUND OF THE INVENTION

From the applicant's earlier FI Patent No. 80,522, a solution is known in which the pressure between a curved measurement rib and a web and, on its basis, the tension of the web are measured. The pressure between the curved rib and the web is passed to a pressure measurement detector, in which connection, by means of a pressure-difference detector operating as the measurement detector, the pressure between the measurement rib and the web is measured from a so-called air cushion.

From the applicant's earlier Patent Application FI-930366 an arrangement of a measurement device is known in which the cross-direction variation in the web tension can be changed to the desired level. The web is made to run over a so-called airborne rib, which consists of a curved face, in which connection the air pressure formed between the airborne rib and the web is measured, and, on the basis of said measurement values, positions signals are passed to an actuator, in which connection the cross-direction variation in the web tension can be changed to the desired level.

However, the measurement of tension is not used for regulation of the difference of draw in the web in any of the prior-art solutions described above.

Determination of the difference of draw has taken place mainly empirically. In such a case, for example, in connection with a free draw, visual observation has been used for determination of the difference of draw. Separation of the web in connection with a free gap, for example, from the centre roll in a press section has been observed.

OBJECTS AND SUMMARY OF THE INVENTION

In the present patent application, it is suggested that the difference of draw be determined and regulated based on measurement of the tension of the web.

In an embodiment of the invention, the measurement of tension takes place by means of a so-called weighing roll. At the ends of the weighing roll, the loading of the roll is measured by means of detectors, and, when the load becomes higher as the web loads the roll with a certain tension, the web tension can be computed directly from the increase in loading measured by means of the detectors. In an embodiment of the invention, measurement of the web tension is based on measurement of the pressure in an air space between the web and a backup face.

Thus, in the commonest embodiment of the invention, the difference of draw is regulated based on the result of measurement of the web tension. The difference of draw is preferably regulated in a paper/board machine by regulating the motors of the drives at the inlet side and outlet side of a free gap. Advantageously, the measurement is carried out between the drives at the inlet side and outlet side of a so-called free gap, i.e. a gap not supported by a wire. For measurement of the web W tension, it is possible to use a weighing roll, in the way described above, in which connection the load applied by the web to the roll is observed by means of detector devices of the weighing roll, and on this basis the tension of the web at the roll is determined. In the way described above, measurement of the web tension can be based, for example, on measurement of a pressure which is measured between a backup face in the free gap, for example a roll, and the web. Thus, it has been realized to use measurement of pressure for fitting together of the web tension profile and the difference of draw. From the air space between the web W and the measurement face, the air pressure is measured, and by means of said pressure data the draw difference of the web is regulated so that the desired tension is obtained for the web. The measurement face can be a separate face of a measurement rib or the face of a separate roll. In such a case, the pressure is passed from between the roll face and the web into a pressure space placed in the interior of the roll and further to a measurement detector, which may be placed separately or in connection with said pressure space in the roll. The roll may be revolving or non-revolving. The pressure can be measured from each hole separately (tension profile in the cross direction of the machine), or several holes can communicate with one measurement detector.

When a non-revolving roll is used, the construction of the measurement device may consist of a roll in which the measurement chamber is fitted in the interior of the roll and holes have been fitted to be opened into the roll interior over a certain sector across the entire width of the sector. In such a case, the measurement pressure can be obtained from a wider area, and a better average value can be obtained from the measurement. When a revolving roll is used, it is enough that perforations have been made through the roll mantle into the measurement chamber in one row in the longitudinal direction of the roll.

When the web has a speed $V_1$ in the first nip and a speed $V_2$ in the second nip, the relative difference in speed that is obtained is:

$$\varepsilon = \frac{V_2 - V_1}{V_1}$$

When the relative difference in speed $\epsilon$ becomes higher, the tension produced in the web, i.e. the web tension T, also becomes higher. With a certain value of $\epsilon$ the web is broken, and, on the other hand, when $\epsilon$ is too low, i.e. the difference in speed is not sufficient, fluttering arises in the web.

The web tension T is formed by the sum $T_1+T_2$, wherein the tension $T_1$ is computed from the formula:

$$P = \frac{T_1}{R}$$

wherein P is the pressure applied to the web, and R is the curved face over which the web is passed, for example a roll used for guiding the web. $T_2$ is composed of a mass and speed term, in which M is the bas is weight of the web and V is the speed of the web. Thus, for the overall expression, the value $T=P\cdot R+MV^2$ is obtained.

When the speed of the web and the pressure applied to the web are known, from the above formula it is possible to compute the overall tension of the web, and, based on said computed value, if necessary, it is further possible to adjust the difference in speed, i.e. it is possible to act upon the values $V_1$ and $V_2$ in the vicinity of the measurement point.

In a preferred embodiment of the invention, the tension of the web is estimated by passing the web over a curved measurement face, for example a roll, and by measuring the pressure P present between the web and the measurement face. Based on the measured pressure, the tension of the web is detected at the measurement point and preferably, in a paper/board machine, at a free and unsupported draw of the web, and based on the measurement data thus obtained, the difference of draw between the inlet side and the outlet side of the free gap is regulated, for example, by regulating the drives of rolls at the inlet side and at the outlet side.

In the present patent application, the invention is not supposed to be confined exclusively to such regulation of a difference of draw and, thereby, to such regulation of the web tension in which the measurement device is placed exclusively in connection with a roll. As was described above, the web may also be made to run over a curved rib face or equivalent, which rib face has a certain curve radius and from which rib face flow openings are opened through the rib across the width of the web, said openings passing into a pressure monitoring space placed at the opposite side of the rib.

In the solution in accordance with the invention, the web tension is regulated, on the basis of the pressure measured at a free draw (unsupported draw) of the web between a measurement face and the web, by regulating the difference in speed between the drive motors placed at both sides of the free gap.

In accordance with the invention, the difference of draw is regulated preferably at the drives between the third press and the fourth press, between which presses the web has a free draw (an unsupported web draw), and favourably said difference of draw can also be regulated between the fourth press and the first drive motor of the dryer section, between which drives there is also a free draw of the web.

Thus, based on the difference in pressure between the web and a measurement face, the web tension is measured, and based on said data on tension, the difference of draw is regulated preferably between a drive that precedes a free draw of the web and a drive following after said free draw by regulating the speeds of rotation of the motors of said drives.

BRIEF DESCRIPTION OF THE DRAWINGS

The invention will be described in the following with reference to some preferred embodiments of the invention illustrated in the figures in the accompanying drawings, the invention being, yet, not supposed to be confined to said embodiments alone.

DETAILED DESCRIPTION OF THE INVENTION

Figure 1A:
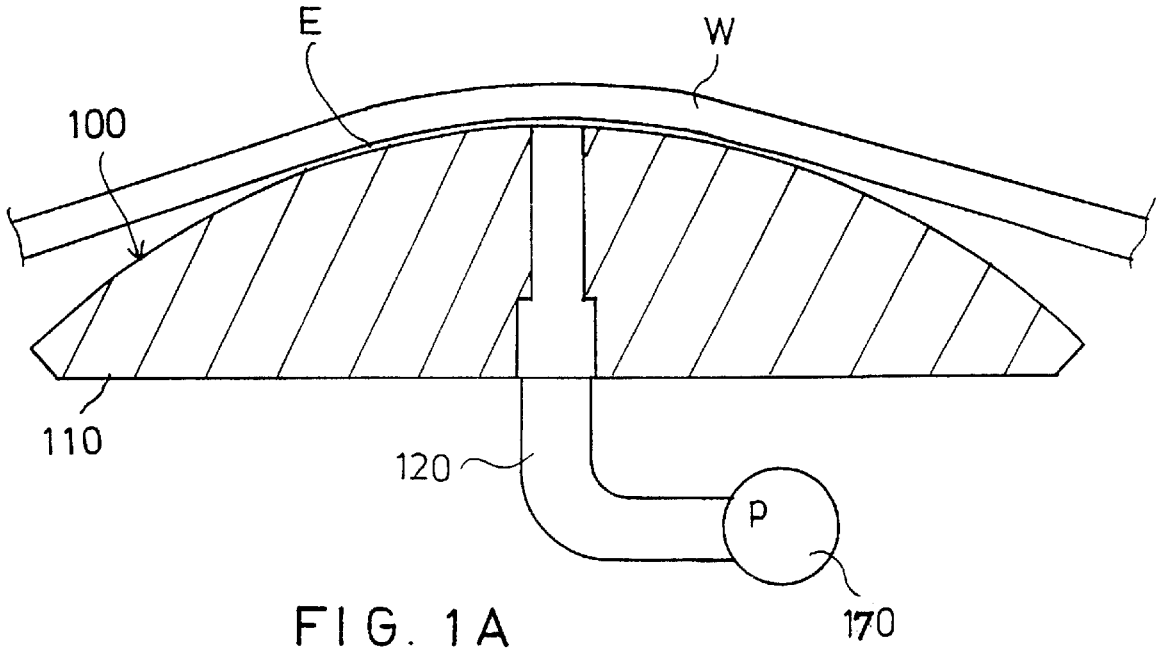
FIG. 1A illustrates a principle of measurement, wherein the web is made to run along the measurement face, preferably the face of a measurement rib, and in the solution of equipment the pressure is measured from the air space placed between the web and the face of a measurement rib.

As is shown in FIG. 1A, the web W is transferred over the measurement face 100. In the embodiment shown in the figure, the measurement face 100 is the outer face of a measurement rib 110. From the measurement face 100, a duct 120 passes to the detector 170, in which connection the pressure P is measured from the air space E between the web W and the measurement face 100. Thus, based on said pressure data, the tension of the paper web W is obtained indirectly. Based on said tension data, the web tension is regulated further to the desired level by regulated the difference of draw between the drives provided at both sides, i.e. at the inlet side and at the outlet side, of the so-called free draw of the web W.

Figure 1B:
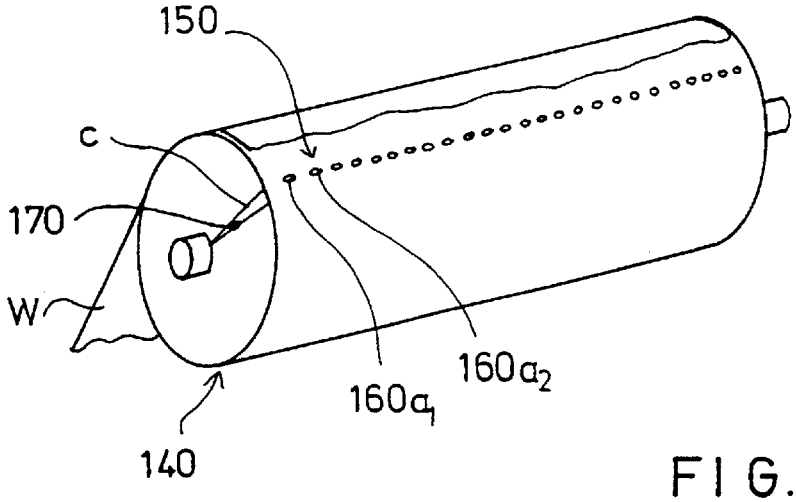
FIG. 1B illustrates a second solution of the mode of measurement, wherein the pressure is measured from between the web and the face of a roll while the roll comprises perforations through which the pressure is passed to the detectors.

FIG. 1B illustrates a second embodiment of the mode of measurement in accordance with the invention, wherein the web is made to run along the face 150 of the roll 140, and the pressure is measured from the air space E between the web W and the face 150. As is shown in the figure, the roll 140 includes perforations 160$a_1$, 160$a_2$ . . . on its face, through which perforations the pressure is passed to the detector 170 in the measurement chamber C. The roll can be revolving or non-revolving. The holes 160$a_1$, 160$a_2$ . . . are opened into the measurement chamber C in the interior of the roll, in which chamber the detector/detectors that 170 measures/measure the pressure p is/are placed.

In the solution in accordance with the invention, each perforation extending across the width of the roll or a certain group of holes across the distance of the length concerned can comprise a separate detector, in which case it is also possible to determine the tension profile of the web across the width of the web.

Figure 1C:
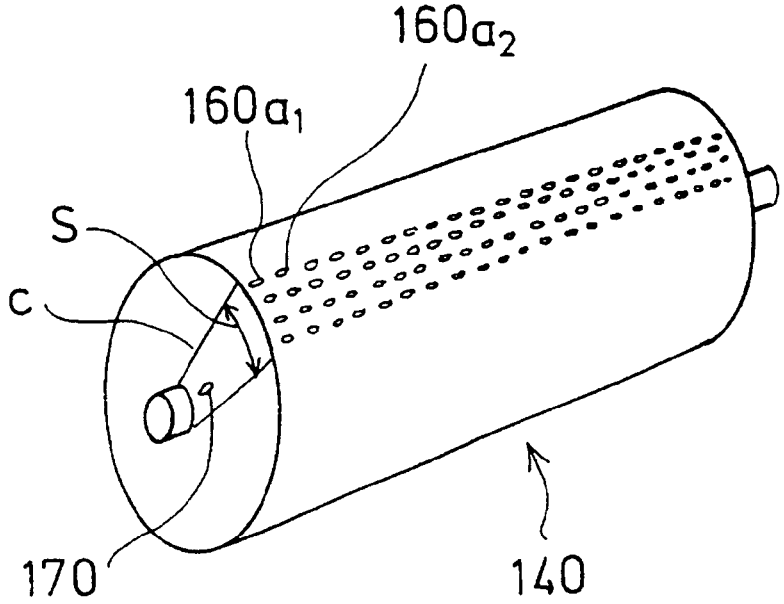
FIG. 1C shows such a roll for use in measurement as comprises perforations provided in the roll face on a certain sector, in which connection the pressure can be measured from the area of a certain sector.

FIG. 1C shows an embodiment corresponding to FIG. 1B, but in the embodiment of FIG. 1C the measurement data are passed within a certain sector S to the measurement detector, in which connection the pressure data obtained correspond to a certain average pressure value over a wider sector-shaped measurement area. The roll 140 shown in the figure can also be non-revolving. The holes 160$a_1$, 160$a_2$ . . . are opened over a wider sector area into the measurement chamber C in the interior of the roll 140, in which chamber the detector 170 for measurement of pressure is placed.

Figure 1D:
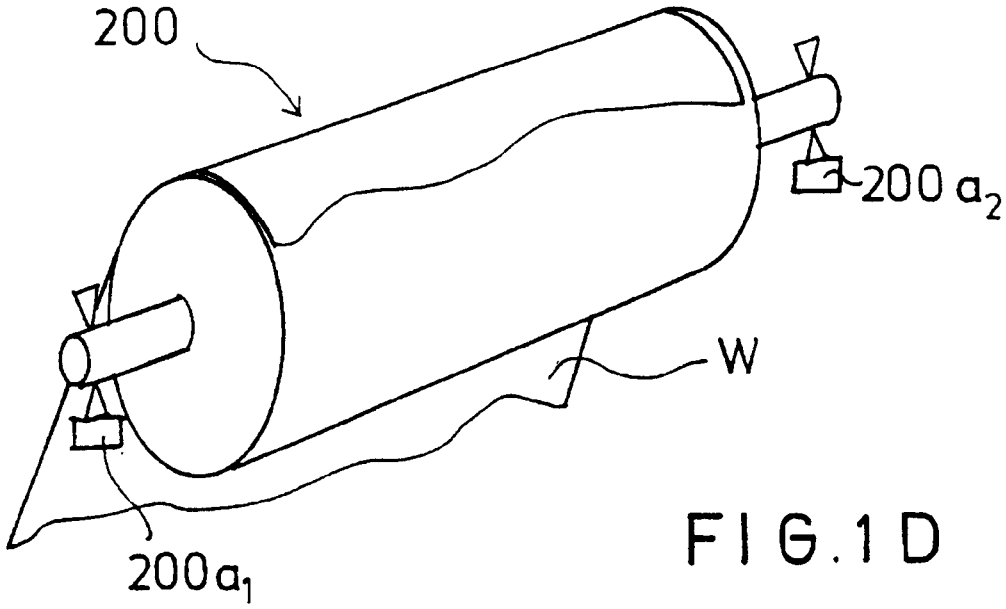
FIG. 1D illustrates a so-called weighing roll.

FIG. 1D shows a so-called weighing roll 200, by whose means it is possible to measure the tension of the web W. Loading detectors 200$a_1$ and 200$a_2$, have been fitted at the ends of the roll 200. By means of the detectors 200$a_1$ and 200$a_2$, the increase in load produced by the web W is measured, and thereby it is further possible to compute/determine the tension of the web W at the roll 200.

Figure 2:
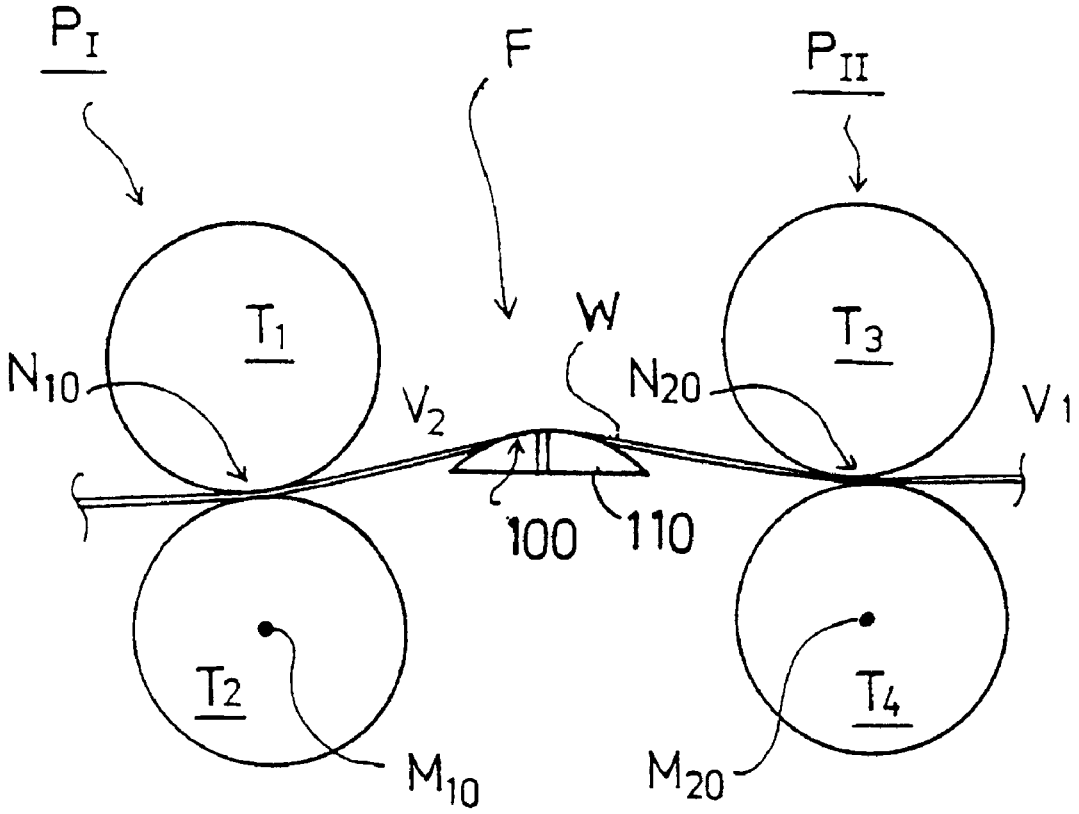
FIG. 2 illustrates the principle of carrying out the regulation of the difference of draw in accordance with the invention.

FIG. 2 illustrates the main principle of the method in accordance with the invention. Between the press nips $N_{10}$ and $N_{20}$ of the presses $P_I$ and $P_{II}$, there is a free draw F, in which connection the pressure p is measured from the space E between the measurement face 100 of the rib 110 of the web, and by means of said measured pressured the difference of draw $V_1$–$V_2$ between the driven presses $P_I$ and $P_{II}$. $V_1$ is the speed of the web W at the press $P_{II}$, and $V_2$ is the speed of the web W at the press $P_I$. Thus, as shown in the figure, the speed(s) of rotation of the drive motor $M_{10}$ of the rolls $T_1$ and $T_2$ that form the nip $N_{10}$ and/or the drive motor $M_{20}$ of the rolls $T_3$ and $T_4$ that form the nip $N_{20}$ is/are regulated. It is the main principle that the difference in speed $V_2$–$V_1$ of the web between the nips $N_{10}$ and $N_{20}$ is adjusted by regulating a drive motor. In order that a tension could be formed in the web W over the free gap F, the speed $V_1$ of the web w in the nip $N_{20}$ and in the press $P_{II}$ is higher than the speed $V_2$ of the web W in the nip $N_{10}$ and in the press $P_I$.

Figure 3A:
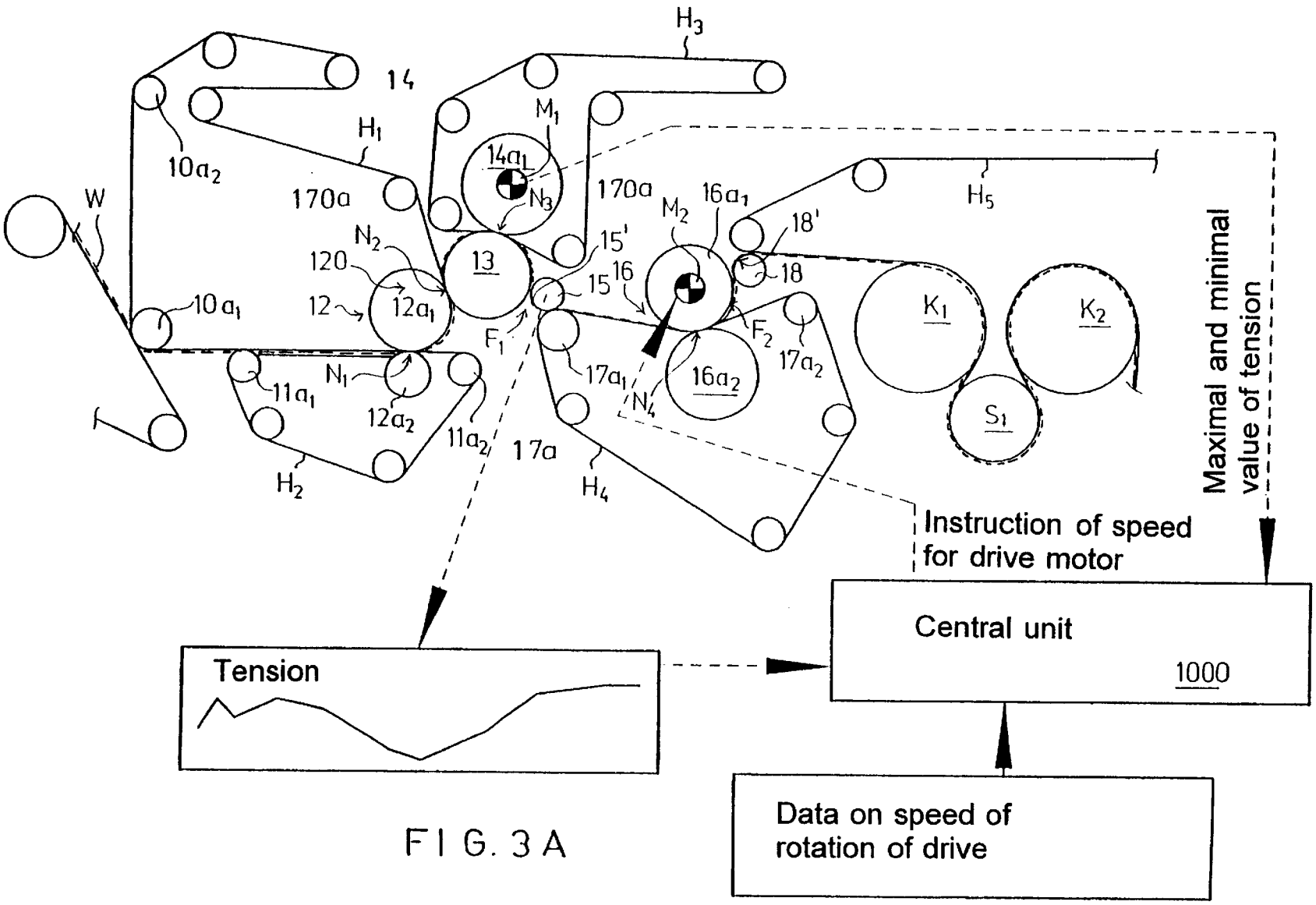
FIG. 3A illustrates an application of the principle of regulation as shown in FIG. 2, in accordance with the invention, in the press section of a paper machine.

FIG. 3A illustrates the method in accordance with the invention as applied to a press section P. The web W is passed between the felts $H_1$ and $H_2$ on arrival in the press section P. The felt $H_1$ is passed over the felt guide rolls 10$a_1$, 10$a_2$ . . . 10$a_n$, and similarly the felt $H_2$ is passed over the felt guide rolls 11$a_1$, 11$a_2$ . . . 11$a_n$. The web is passed into the first press 12 in the press P, which press 12 comprises the press rolls 12$a_1$, 12$a_2$. From the nip $N_1$ the web is transferred further into the second press 120, into its nip $N_2$ formed between the centre roll 13 and the press roll 12$a_1$, and further, along the centre roll 13, into the third press 14 in the press section P, into the nip $N_3$ formed between the press roll 14$a_1$ and the centre roll 13. After this the web W is transferred from the nip $N_3$ of the third press 14 through a free draw $F_1$ onto the transfer roll 15. The transfer roll 15 comprises a measurement face 15', in which connection, in the solution of equipment, the pressure is measured from between the web W and the measurement face 15', and by making use of said pressure data, the tension of the web W is determined, and based on said determined web W tension, the difference of draw $V_1$ –$V_2$ in the web W and, thus, the tension of the web W, are regulated to the desired level. Advantageously, the regulation of the difference of draw $V_1$–$V_2$ in the web is carried out between the drive at the inlet side and the drive at the outlet side of the so-called free draw, i.e. unsupported draw $F_1$, of the web. The web W is passed further from the roll 15 into connection with the transfer felt $H_4$ and along with said felt into the fourth press 16, into the nip $N_4$ formed between the press rolls 16$a_1$ and 16$a_2$. The felt $H_4$ has been passed over the felt guide rolls 17$a_1$, 17$a_2$ . . . 17$a_n$. Similarly, the felt $H_3$ has been passed over the felt guide rolls 170$a_1$, 170$a_2$ . . . In the regulation of the difference of draw $V_1$–$V_2$, in the embodiment shown in FIG. 3A, $V_1$ is the speed of the paper or board web W at the outlet side of the free gap $F_1$ at its first drive, in the embodiment of FIG. 3A at the driving nip $N_4$ of the fourth press 16. $V_2$ is the speed of the paper or board web at the inlet side of the free gap $F_1$ at the first drive related to its inlet side, in the embodiment of FIG. 3A at the driving nip $N_3$ of the third press 14.

From the fourth press 16, the web W is passed further through the free draw $F_2$ onto the transfer roll 18 and further into the dryer section. The air pressure p is measured from between the face 15' of the transfer roll 15 and the web W, and, based on the measurement data, thus, the tension of the web W is determined indirectly, and on its basis the web W tension is regulated further by regulating the difference of draw.

The web is passed further from said second transfer roll 18 into the dryer section R into its first drying group $R_I$ onto the first drying cylinder $K_1$ in said group along with the lower face of the wire $H_5$ of the single-wire draw, for example, supported by a vacuum suction.

As is shown in FIG. 3A, the difference of draw is regulated by regulating the speed of the web W between the roll 16$a_1$ of the fourth press 16 and the roll 14$a_1$ of the third press 14. In accordance with the invention, the drive motor $M_2$ of the fourth press 16, preferably the motor $M_2$ that drives the roll 16$a_1$, is regulated. Before this, information concerning the operation has been received from the drive motor $M_1$ of the third press 14, preferably from the drive motor $M_1$ of the roll 14$a_1$, concerning its speed of rotation. The regulation can be carried out by regulating the motor $M_1$ or $M_2$ or both of said motors.

Figure 3B:
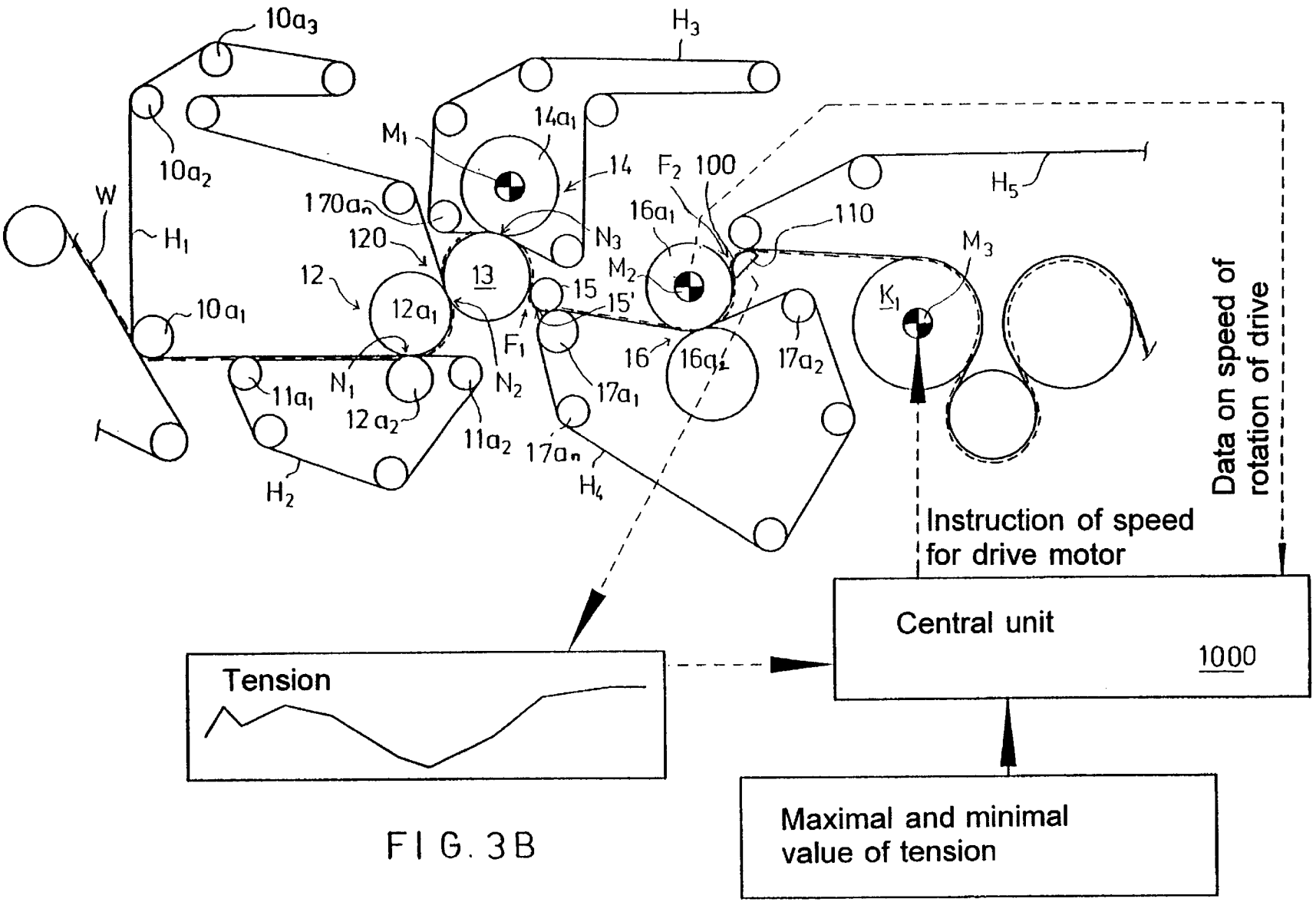
FIG. 3B shows a second embodiment of the regulation in accordance with the invention, wherein the difference of draw is regulated between the dryer section and the last press, i.e. a so-called separate press, in the press section.

FIG. 3B illustrates a second embodiment of the invention, in which the drive motor $M_3$ of the first drive in the dryer section R, i.e. of the drive of the drying cylinder $K_1$, and the drive motor $M_2$ of the press roll 16$a_1$ of the fourth press 16 are regulated. For the purpose of regulation, the data concerning the speed of rotation of the drive motor $M_2$ of the press roll of the fourth press 16 are passed into the central unit 1000, and, based on the data on the pressure in the air space E between the web W and the measurement face 100 of the measurement rib 110, the tension of the web is determined. The data concerning this are transferred into the central unit 1000, and, within the range between the maximal and minimal values of the tension, an instruction of speed is regulated for the drive motor $M_3$ of the drying cylinder $K_1$ of the first drying group $R_1$ in the dryer section R so as to operate the drying cylinder $K_1$ at a certain speed of rotation. Regulation of the difference in speed, i.e. of the difference of draw, $V_1$–$V_2$ can be carried out by regulating the speed of rotation of the motor $M_3$ or $M_2$ or by regulating both of the motors $M_2$ and $M_3$. In stead of a measurement rib 110 it is also possible to employ a roll 18, as is illustrated in FIGS. 3A, 1B and 1C, or the tension can be measured in said position by means of a weighing roll 200. When the difference of draw $V_1$–$V_2$ is being regulated, in the embodiment of FIG. 3B, $V_1$ is the speed of the paper or board web W at the outlet side of the free gap $F_2$ at the drive first connected with the free gap, in the embodiment of the figure, at the drive of the drying cylinder $K_1$. $V_2$ is the speed of the paper or board web W at the inlet side of the free gap $F_2$ at the drive most closely connected with the inlet side of the free gap $F_2$, in the embodiment of FIG. 3B, at the nip $N_4$ of the fourth press 16.

We claim:

1. An arrangement in a paper/board machine for regulating the difference of draw of a web, said arrangement comprising:

means for determining the tension of the web; and means for adjusting the difference of draw based on said determined tension of the web;

wherein said means for adjusting the difference the draw comprises first and second motors of first and second nip rolls arranged respectively at an inlet side and outlet side of a free gap of the web; and wherein said means for determining the tension of the web is arranged in the free gap of the web between said first and second motors.

2. The arrangement according to claim 1, wherein said means for determining the tension of the web is an air pressure detector structured and arranged to measure an air pressure between the web and a roll, whereby based upon air pressure a tension of the web is calculated.

3. The arrangement according to claim 1, wherein said means for determining the tension of the web is a plurality of load detectors arranged on a roll for measuring a load applied to the roll by said web, whereby based upon said measured load a tension of the web is calculated.

4. The arrangement according to claim 1, wherein said web is passed into a press section into and through a first press and into a second press formed between a center roll of the press section and a press roll of said first press, said web being passed into a third press formed between said center roll and the press roll, said web passed through a free draw and over a transfer roll in to a fourth press and from the fourth press through a second free draw and over a second transfer roll into a dryer section, wherein said means for determining the tension of the web is arranged to measure the tension of the web between said third and fourth press and said means for means for adjusting the difference of draw is arranged to regulate the difference of draw between said third and fourth press.

5. The arrangement according to claim 4, wherein said means for determining the tension of the web is an air pressure detector.

6. The arrangement according to claim 5, wherein based upon said measured tension of the web a drive motor of the fourth press and a drive motor of the third press is regulated.

7. The arrangement according to claim 1, wherein said web is passed into a press section (P) into and through a first press and into a second press formed between a center roll of the press section and a press roll of said first press, said web being passed into a third press formed between said center roll and the press roll, said web passed through a free draw and over a transfer roll in to a fourth press and from the fourth press through a second free draw and over a transfer roll into a dryer section and over a first drying cylinder, wherein said means for determining the tension of the web is arranged to measure the tension of the web between said fourth press and said first drying cylinder, and said means for adjusting the difference of draw is arranged to regulate the difference of draw between said fourth press and said first drying cylinder.

* * * * *